United States Patent [19]

Anderson

[11] Patent Number: 4,960,168

[45] Date of Patent: Oct. 2, 1990

[54] HEAT EXCHANGER

[76] Inventor: Raymond L. Anderson, Box 3031, Langley, British Columbia, Canada, V3A 4R3

[21] Appl. No.: 345,118

[22] Filed: Apr. 28, 1989

[51] Int. Cl.[5] ..... F28F 5/04

[52] U.S. Cl. ..... 165/92; 165/96

[58] Field of Search ..... 165/92, 96

[56] References Cited

U.S. PATENT DOCUMENTS 1,561,461 11/1925 Choinski ..... 165/96

FOREIGN PATENT DOCUMENTS 256037 5/1963 Australia ..... 165/92

2433351 1/1975 Fed. Rep. of Germany ..... 165/92

*Primary Examiner*—Alan Cohan

*Assistant Examiner*—Allen J. Flanigan

*Attorney, Agent, or Firm*—Christie, Parker & Hale

[57] ABSTRACT

A heat exchanger fan having a hollow central shaft. Hollow blades are formed on the central shaft and a peripheral flange is attached to the distal ends of the hollow blades. The interior of the shaft communicates with the interior of the blades, and openings at the distal ends of the blades extend through the peripheral flange.

14 Claims, 3 Drawing Sheets

HEAT EXCHANGER

FIELD OF THE INVENTION

This invention relates to a heat exchanger fan, particularly an air to air heat exchanger fan and to a structure including the fan. The invention has particular use in a building.

DESCRIPTION OF THE PRIOR ART

Heat exchangers are well known. They are a necessary part of any cooling system used to dissipate heat. In this use relatively crude and inefficient exchangers are acceptable but there are applications where efficiency is required. Efficiency, generally stated, is the ability to transfer the maximum possible amount of heat from one fluid to another. In, for example, a heating system high efficiency is desirable. Unlike an internal combustion engine, heat generated is not a by-product of operation but is the main purpose of operation. Its generation is expensive and the maximum possible use is therefore desired.

The present invention seeks to provide a heat exchange fan for a gas to gas heat exchanger that has high efficiency.

SUMMARY OPF THE INVENTION

More particularly, the present invention is a heat exchanger fan comprising:

a hollow central shaft;

a plurality of hollow blades formed on the central shaft;

a peripheral flange attached to the distal ends of the hollow blades;

means communicating the interior of the shaft with the interior of the blades; and openings at the distal ends of the blades extending through the peripheral flange.

In a further aspect the invention is a fan as defined above located in a casing;

a channel within the casing, open at its inner edge to engage with the peripheral flange of the fan to communicate with the interior of the hollow fan.

BRIEF DESCRIPTION OF THE DRAWINGS

Aspects of the invention are illustrated, merely by way of example, in the accompanying drawings in which.

DESCRIPTION OF THE PREFERRED EMBODIMENTS

Figure 3:
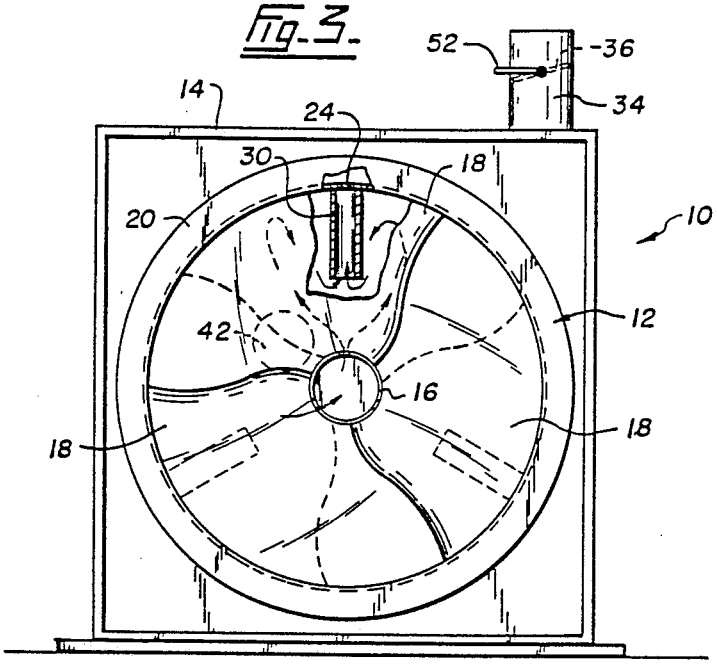
FIG. 3 is a front elevational view of the apparatus of FIG. 1 with the front of the casing removed.
Figure 4:
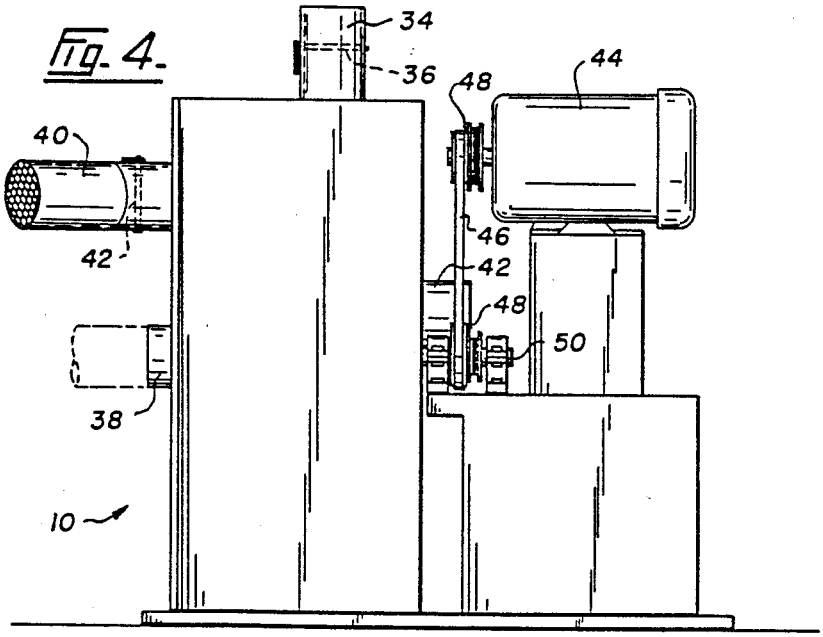
FIG. 4 is a side elevational view of the apparatus of FIG. 1.

The drawings show a heat exchanger 10 comprising a heat exchanger fan 12 located within a casing 14. The heat exchanger fan 12 has a hollow central shaft 16. There are a plurality of hollow blades 18 formed on the central shaft 16. As shown particularly in FIG. 3 there is a substantial amount of overlap of the blades 18 of the fan 12 where one overlapped edge of each blade 18 is shown in phantom lines.

There is a peripheral flange 20 attached to the outer ends of the hollow blade 18.

The interior of the shaft 16 communicates with the interior of the blades 18 through openings 22. There are also openings 24 at the outer ends of the blades 18, extending through the peripheral flange 20.

The fan 12 is located in casing 14. There is a channel 26 in the casing 14, open at its inner side, to engage with peripheral flange 20 of the heat exchanger fan 12 and thus, of course, to communicate with the interior of the hollow shaft 16, There is a seal 28 at the joint between the channel 26 and the flange 20. The channel 26 is, of course, static while the flange 20 moves with the fan 12.

Figure 2:
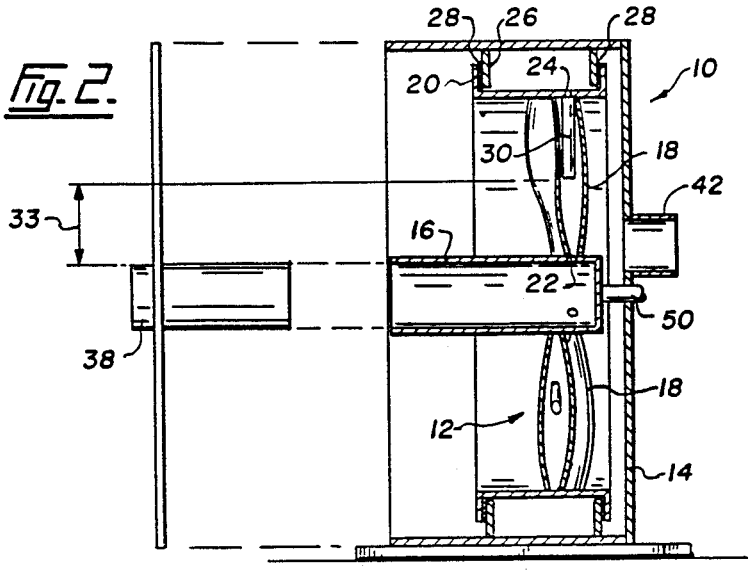
FIG. 2 is a section through the casing of FIG. 1.

Tubes 30 extend inwardly from the openings 24 in the peripheral flange 20 of the fan 12. These tubes 30 extend inwardly to a height 33 above the central shaft 22— see FIG. 2. Height 33 can be varied to change the dwell of air within the fan 12.

There is a first outlet 34 in the casing communicating with the channel 26 and there is a flap valve 36 providing means to control opening of this first outlet 34. There is a first inlet 38 in the casing 14 to communicate with the interior of hollow central shaft 16 and thus, through openings 22, with the interior of fan 12 and, through openings 24, with channel 26.

There is a second outlet 40 in the casing 14 to allow gas to pass from the casing and, again, a flap valve 42 provides means to control opening and closing of the second outlet 40.

A second inlet 42 in the casing 14 allows air to be drawn into the casing 14. The second inlet 42 is on the opposite side of the fan 12 from the second outlet 40.

A motor 44, typically an electric motor, drives the fan 12. The motor 44 drives through belt 46 attached to a pulley 48 on drive shaft 50 of the cnetral hollow shaft 16. Of particular importance is the provision of sensors 52 (shown schematically in FIG. 1) to sense air temperature difference between the areas on opposed sides of the fan 12. By this means the valves 36 and 42 in the air outlets 30 and 40 are opened and closed and, as a result, air flow throughout the system is controlled.

In operation throttling of the inlet pipe 38 from the outside controls the volume of air forced into the exchanger. Control of outlet 34 can also extend or reduce the residence time and hence the exposure to separate air flows across the fan 12. Air flow is through inlet 38, across fan 12, under the influence of fan 12, and out through outlet 34. Air from the other direction, that is from the interior of the building, enters pipe 38, passes through openings 22 to openings 24, through blades 18 of fan 12 to channel 26 to outlet 34. Air passing along an outer surface of the fan enters into heat exchange with the air on the inside of the fan. The dwell of the air within the fan is controlled by the length of the tubes 30 and by the speed of the fan 12. Fan 12 acts as a primary moving force for both the inlet fresh air and the exhausting air through outlet 34. Air is moved centrifugally in the interior of the fan 12 by the speed of rotation and the air tends to collect at the outermost sections of the interior of the fan 12. The coldest, densest air is most outward and as it is heated by heat exchange it expands and moves by convection through the tubes 30.

Figure 1:
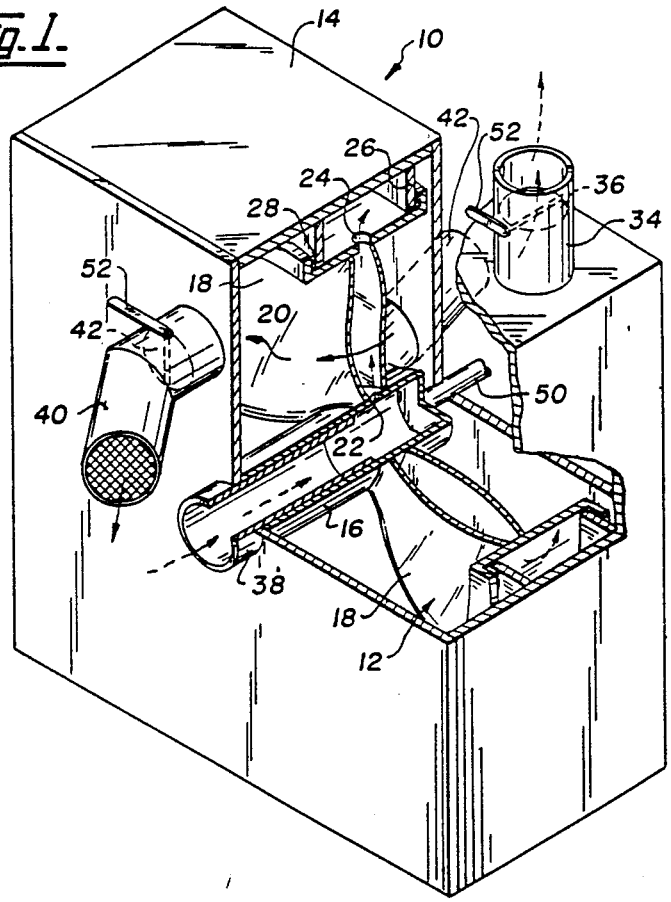
FIG. 1 is a perspective view, partially broken away, of a fan and a casing according to the present invention.
Figure 5:
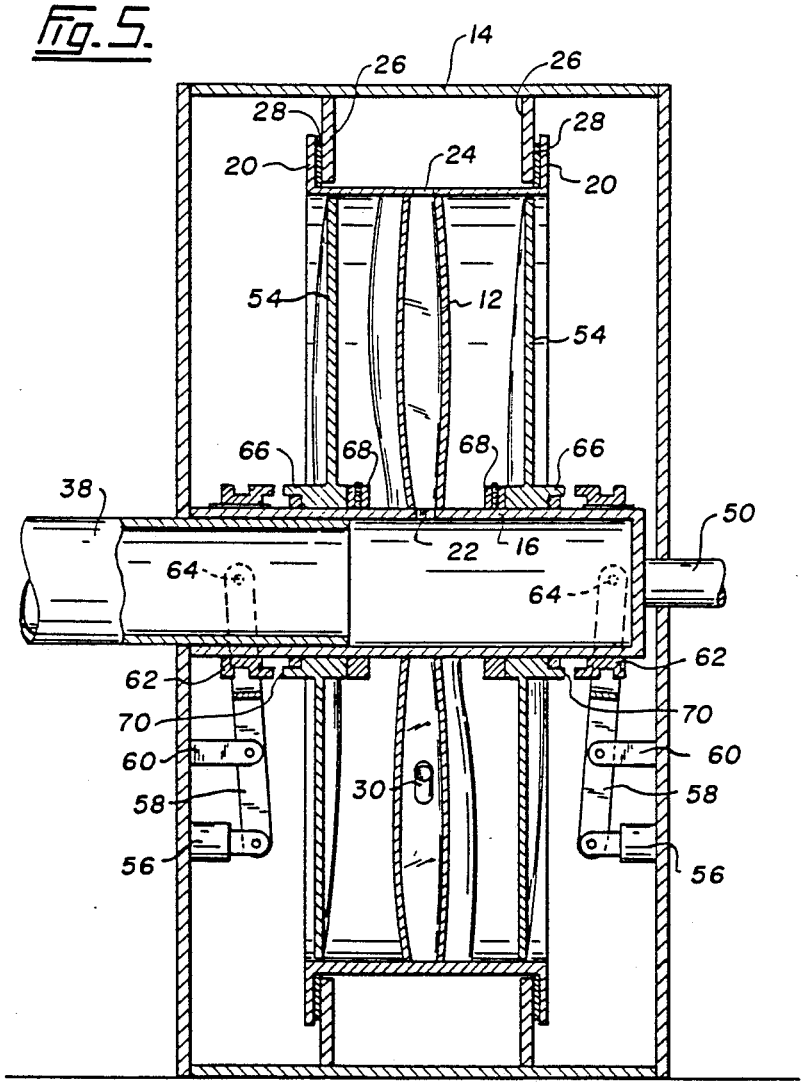
FIG. 5 is a side elevation, in section, of a preferred embodiment of the invention.

A preferred embodiment of the invention is shown in FIG. 5 FIG. 5 is the apparatus of FIG. 1 in essence and the same reference numerals are used for common parts. However, the apparatus of FIG. 5 has ancillary fans 54 able to move from a first position, where the fans are locked on the shaft 16 and thus driven with the shaft 16 and with the fan 12, to a second position, shown in solid lines in FIG. 5, where the ancillary fans 54 are not driven by the shaft 16. Two ancillary fans 54 are shown in FIG. 5; in certain circumstances one may be sufficient.

The illustrated drive mechanism for these fans comprises a solenoid 56, operating a lever 58 pivotally attached to a fulcrum 60 and to a thrust ring 62 at 64. Ring 62 slides longitudinally of shaft 16, which carries ring 62 with bearing clearance. When the solenoid 56 is retracted lever 58 moves inwardly to push in the thrust ring 62. The thrust ring 62 engages a hub 66 of ancillary fan 54 to force the hub 66 into frictional engagement with high friction members 68 located on the shaft 16. Thrust rings 62 have low friction surfaces 70 or, alternatively, a bearing surface, to allow the hub 66 to rotate while being pressed inwardly by the thrust ring 62.

The release of the solenoid 56, that is extension of the solenoid, means that the thrust rings 62 are urged to the retracted position, as shown in FIG. 5, allowing the ancillary fans 54 to idle or rest on the shaft 16.

When the device of FIG. 5 is operating in the air conditioning mode the ancillary fans 54 are moved into contact with the fan 12 to provide additional air flow. Not only that but the motor 44 can also run at two speeds and the highest is used for air conditioning. The solenoids 56 are used to move the ancillary fans 54 into contact with the friction surfaces 68 to ensure that these fans are driven. Fresh air comes through 38 and internal air is exhausted through central pipe 16.

Air flow throughout the system can be requlated by the control of flap valves which, typically are controlled by solenoids.

I claim:

1. A heat exchanger fan comprising:

a hollow central shaft;

a plurality of hollow blades formed on the central shaft;

a peripheral flange attached to the distal ends of the hollow blades;

means communicating the interior of the shaft with the interior of the blades;

opening at the distal ends of the blades extending through the peripheral flange; and at least one ancillary fan on the hollow central shaft, able to move from a first position, where it is locked on the shaft to be driven with the shaft, to a second position where it is not driven by the shaft.

2. A fan as claimed in claim 1 made of a heat conducting material.

3. A fan as claimed in claim 1 in which the means communicating the interior of the shaft with the interior of the blades comprises openings formed in the shaft walls.

4. A fan as claimed in claim 1 in which there is susbstantial overlap of neighboring blades on the hollow central shaft.

5. A fan as claimed in claim 1 in which there is a ancillary fan on each side of the hollow blades.

6. A fan as claimed in claim 1 including baffles within the hollow blades to direct air flow.

7. A fan as claimed in claim 1 in which the heat exchanger fan is located in a casing;

a channel within the casing, open at its inner edge to engage with the peripheral flange of the fan to communicate with the interior of the hollow fan.

8. A fan as claimed in claim 7 including seals at the joint between the channel and the flange.

9. A heat exchange fan as claimed in claim 7 including a first outlet in the casing communicating with the channel and means to control opening and closing of the first outlet.

10. A fan as claimed in claim 7 having a first inlet in the casing to communicate with the interior of the hollow control shaft.

11. A fan as claimed in claim 7 having a second outlet in the casing to allow gas to pass from the casing and means to control opening and closing of the second outlet.

12. A fan as claimed in claim 10 including a second inlet in the casing to allow air to be drawn into the casing, the second inlet being on the opposite side of the fan from the second outlet.

13. A fan as claimed in claim 7 including a motor to rotate the hollow shaft to drive the heat exchange fan.

14. A heat exchanger fan comprising:

a hollow central shaft;

a plurality of hollow blades formed on the central shaft;

baffles within the hollow blades to direct air flow;

a peripheral flange attached to the distal ends of the hollow blades;

means communicating the interior of the shaft with the interior of the blades; and openings at the distal ends of the blades extending through the peripheral flange.

* * * * *